US005241994A

United States Patent [19]

Günther et al.

[11] Patent Number: 5,241,994

[45] Date of Patent: Sep. 7, 1993

[54] RAPIER LOOM HAVING A PICKING MECHANISM ADJUSTABLE TO YARN PROPERTIES

[75] Inventors: Kurt Günther, Rüti; Angelo Stacher, Arbon; Theo Thalmann, St. Gallen, all of Switzerland

[73] Assignee: Sulzer Brothers Limited, Winterthur, Switzerland

[21] Appl. No.: 900,889

[22] Filed: Jun. 18, 1992

[30] Foreign Application Priority Data

Jul. 24, 1991 [CH] Switzerland ..... 02204/91

[51] Int. Cl.[5] ..... D03D 47/18

[52] U.S. Cl. ..... 139/449; 139/446; 139/448

[58] Field of Search ..... 139/449, 446, 448, 443

[56] References Cited

U.S. PATENT DOCUMENTS 4,022,253 5/1977 Trost ..... 139/446
4,630,651 12/1986 Windischbauer ..... 139/446

FOREIGN PATENT DOCUMENTS 0248486 12/1987 European Pat. Off. .
3224708A1 1/1984 Fed. Rep. of Germany .
2381850 9/1978 France .
2085039 4/1982 United Kingdom .

*Primary Examiner*—Andrew M. Falik
*Attorney, Agent, or Firm*—Townsend and Townsend Khourie and Crew

[57] ABSTRACT

A rapier loom has a picking mechanism in which one rapier (a giver rapier) transfers a weft yarn to another rapier (a taker rapier) in mid-shed. Each rapier is oscillated toward and away from one another by a drive and includes a yarn clamp which is actuated by a clamp opener to provide reliable yarn transfer from one rapier to the other. The rapier drives and/or clamp openers are driven by programmed servomotors. In this way, the velocities of the rapiers and/or the interval in which the clamp openers are opened can be adjusted according to the properties of the particular weft yarns used to ensure reliable transfer without damaging the yarn.

7 Claims, 3 Drawing Sheets

Fig.1a
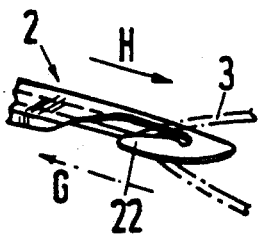
Fig.1b
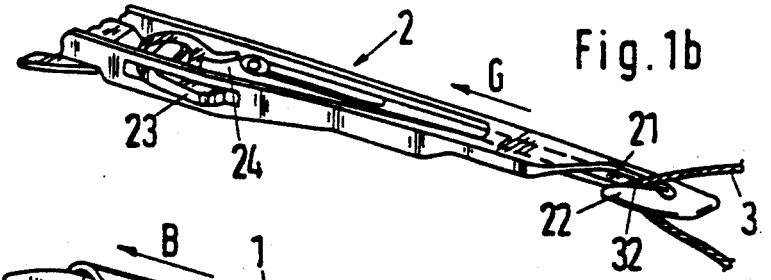
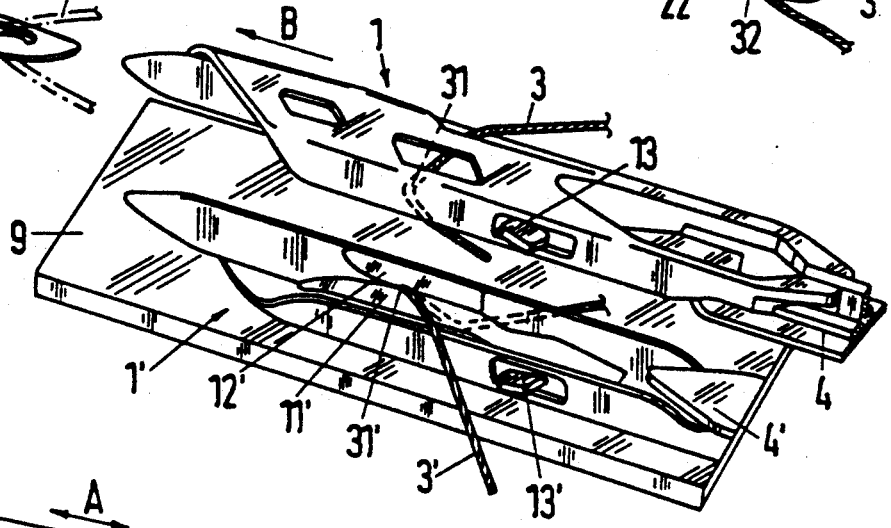
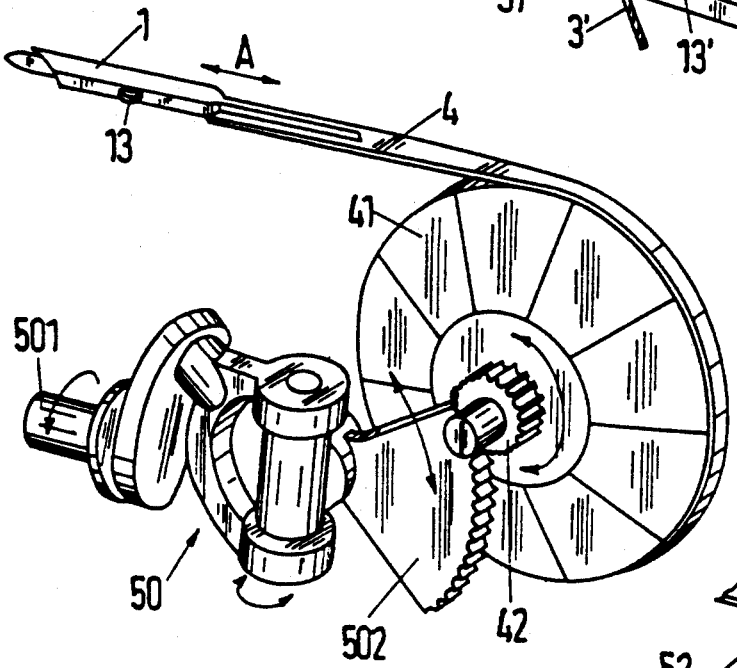
Fig. 2
PRIOR ART
Fig. 3
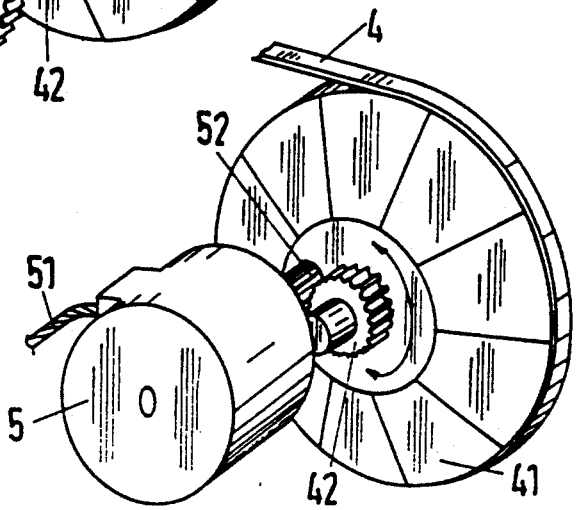

RAPIER LOOM HAVING A PICKING MECHANISM ADJUSTABLE TO YARN PROPERTIES

BACKGROUND OF THE INVENTION

The invention relates to rapier looms generally, and more particularly to rapier looms having adjustable picking mechanisms to accommodate different yarn properties.

In some rapier looms of the relevant kind rapier movement is produced by means of flexible tapes and oscillating tape wheels, the tape wheel drive being coupled with the loom main shaft and being by way of so-called three-dimensional crank drives (see DE-PS 3 029 642=MR 170). The rapier heads have wedge clamps for the weft yarn which enable the yarn to be taken over automatically at the shed entry (by the giver) and at the center of the shed (by the taker) without automatic acutation of the clamps. The actuating levers provided to open the clamps serve to open the clamps by means of cams at the rapier head reversal positions outside the shed in order that fibres which have remained stuck may be cleared, for example, by means of blowing nozzles (also, in the case of the taker, to release the weft yarn).

The automatic yarn clamps of the rapier heads have the advantage of simplifying rapier looms, but disturbances may occur because of the kind of yarn. For example, when a stiff heavy yarn is being processed, there may be mistransfers from the giver to the taker. At yarn transfer the rapiers experience maximum acceleration in the outwards direction of movement because of the drive by the three-dimensional crank system; consequently, a maximum inertia force is effective in the weft yarn of the giver. After the reversal position this inertia force is directed oppositely to the direction of movement during the return of the giver, with the possibility that the weft yarn may slip out of the yarn clamp before being taken over by the taker and thus be unable to be transferred. When endeavours are made to obviate this disadvantage by increasing the clamping force of the giver clamp, a new problem arises, for the yarn may then be damaged, for example, torn, when it is pulled out of the giver by the taker with a force which is bound to be increased because of the increased clamping force.

The problems described relate also to looms having rigid rapiers. The invention therefor relates to such looms as well.

SUMMARY OF THE INVENTION

It is the object of the invention so to improve rapier looms of the kind hereinbefore set out, more particularly their picking mechanisms, that in particular the yarn transfer from the giver to the taker at the center of the shed is performed more reliably than previously, it being necessary for this working step to be adapted to the nature of the particular weft yarn used and to the clamping effect of the rapier clamps. The invention solves this problem by driving the rapiers and yarn clamp openers with servomotors programmed to oscillate the rapiers at selected velocities and actuate the openers for selected intervals in accordance with the properties of the yarn.

Replacing the three-dimensional crank system for the tape wheel drive (or rod drive) by a servomotor provides further freedoms improving adaptation of rapier movements to the yarn takeover or yarn transfer conditions. Also, the special natures of the various yarns can be taken into account individually by means of programmed servomotors, the movement patterns of the rapiers being adapted to the particular weft yarn it is required to pick. For example, the inertia forces at yarn transfer can be reduced without any reduction in loom speed. Also, in the event of a change in cloth width it becomes very simple to adapt the rapier strokes, such adaptation being effected by programmed adaptation of the control logic.

Further freedoms are obtained if the clamp openers according to the invention are disposed at the yarn transfer station at the center of the shed. The clamping force of the yarn clamp can then be set higher since automatic opening of the yarn clamp by the clamp opener prevents the weft yarn from being damaged at transfer. The use of clamp openers is known, for example, from DE-OS 3 224 708. However, in contrast to the known clamp openers the clamp opener according to the invention is driven in programmed manner by a servomotor. One of the resulting advantages is that the clamp opener can be actuated individually—i.e., adapted to the individual yarn type of "weft color". In some circumstances the clamp openers can be actuated just for some of the weft colors.

The two steps according to the invention, viz. tape or rod drive by servomotors and clamp opener actuation also by servomotors, each provide individually a possible improvement of picking. The combination of the two features leads to a very advantageous picking mechanism. Preferably high-dynamic servomotors are used as the servomotors of the rapier drives. A feature of such servomotors is that they can be used in a programmed manner like stepping motors; but they have much greater torques (about 300 Nm) than stepping motors at typical rapier loom speeds of approximately 500 $min^{-1}$ and cloth widths of approximately 2 m.

BRIEF DESCRIPTION OF THE DRAWINGS

The invention will be described in greater detail hereinafter with reference to drawings and diagrams wherein:

FIG. 1*a* shows two rapier heads shortly before they meet at the centre of the shed, the underside of the giver being made visible by means of a mirror image, only the head tip of the taker being shown;

FIG. 1*b* shows the taker of FIG. 1*a* after yarn takeover;

FIG. 2 shows a known tape wheel drive using a three-dimensional crank system;

FIG. 3 shows the drive according to the invention of a tape wheel by means of a servomotor;

DESCRIPTION OF THE PREFERRED EMBODIMENT

Figure 4:
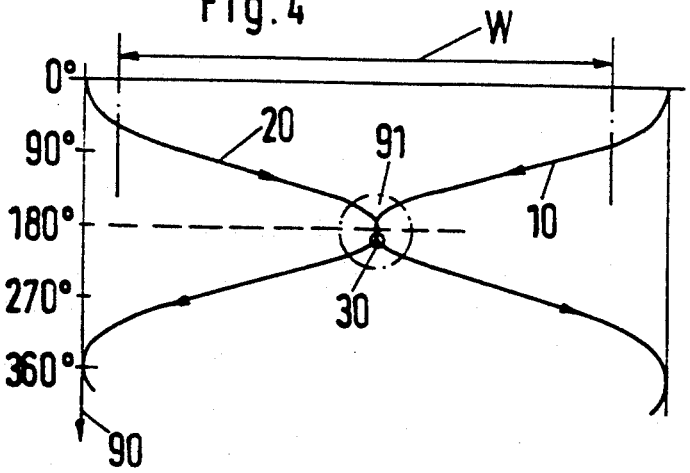
PRIOR ART Fig. 4
FIG. 4 is a diagram of rapier movement when a three-dimensional crank system is used, the movements of the two rapiers being "cophasal"

Referring to FIGS. 1*a* and *b* the rapier loom of the present invention includes two rapiers, the rapier called giver 1 with the weft yarn 3 and the rapier called taker 2. These rapiers are illustrated in FIG. 1*a* as moving towards one another in directions indicated by respective arrows B and H. It will be apparent from the mirror image 1' of the giver 1 how the mirrored weft yarn 3' is retained by the wedge clamp, the same being embodied by two arms 11', 12', at a clamping station 31' (or 31). The arm 11' is resilient so that the yarn clamp can be opened by the pressure of an actuating lever 13' (or 13) connected to the arm 11'. The mirror 9 is of course disposed below the giver 1 purely for purposes of illustration.

The giver 1 is moved by a flexible tape 4 (mirror image 4'). At yarn takeover, the taker 2 is guided into the giver 1 far enough for a hooked tip 22 of the taker 2 to be able to engage the presented weft yarn 3 upon being drawn back (arrow G).

As shown in FIG. 1*b*, the wedge clamp embodied by the hook 22 and the moving clamp part 21 retains the weft yarn 3 at clamping station 32. The wedge clamp is opened outside the shed by the pressure of the lever 23 acting through the mechanism 24 for drawing the part 21 back.

FIG. 2 shows the drive producing the oscillating motion (double arrow A) of the giver 1, such motion being produced by means of the tape 4, tape wheel 41 and three-dimensional crank system 50; a drive shaft 501 rotates at a constant angular velocity which the system 50 converts by way of a gear 42 into an oscillating pivoting movement of the toothed segment 502 and tape wheel 41. FIG. 3 shows the servomotor 5 which in accordance with the invention replaces the drive 50, the pinion 52 replacing the segment 502. The power for the drive and the control signals for the servomotor 5 are supplied by way of a cable 51. The motor 5 can of course be directly connected to the tape wheel without any intermediate transmission.

Referring to the diagram shown in FIG. 4, the operative phase of the loom is plotted on the descending ordinate. This phase is referred in conventional manner to the angular position of the loom main shaft and expressed in loom degrees (MGR). The zero position—i.e. the start of the loom cycle—is in the present example the rapier reversal position outside the shed. The abscissa of the diagram indicates the positions of the rapier heads, more accurately of the clamping stations 31, 32 (see FIGS. 1*a* and 1*b*). The cloth or shed width is indicated by a double arrow W. The two cosinusoidal curves 10, 20 represent rapier movements over one loom cycle as produced by means of three-dimensional crank systems. The transfer of the weft yarn from the giver 1 (curve 10) to the taker 2 (curve 20) occurs within the chain-dotted circle 91 at 180 MGR, the weft yarn starting to be pulled by the taker with effect from position 30. The paths 10, 20 of the respective clamping stations 31, 32 inside the circle 91 are shown to an enlarged scale in FIG. 5 where the horizontal bar marked 10 mm and the vertical bar marked 10°, corresponding to 10 MGR, give some idea of the scales of enlargement.

Figure 5:
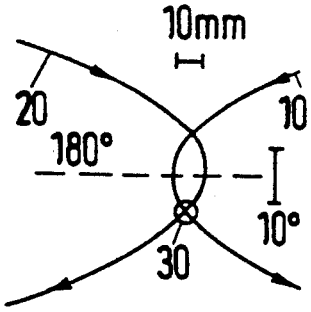
PRIOR ART Fig. 5
FIG. 5 is a view to an enlarged scale of a part of the diagram shown in FIG. 4.
Figure 6:
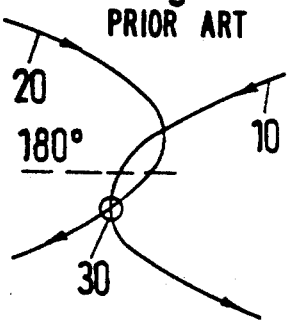
Fig. 6 PRIOR ART
FIG. 6 is a view similar to FIG. 5 but for "out-of-phase" rapier movements.

Whereas FIGS. 4 and 5 show "cophasal" rapier movements, FIG. 6 shows the circumstances associated with "out-of-phase" rapier movements such that the reversal position of the giver occurs some 10 MGR later than the reversal position of the taker. The yarn transfer is "flying" as in a relay movement. Before the "exchange" at the place 30 the two rapier heads move briefly in the same direction, the taker (curve 20) moving at increasing speed and the giver (curve 10) moving at decreasing speed, the giver reaching its reversal position at the place 30 and therefore momentarily stopping (although a maximum accelerating force in the outwards direction is simultaneously being applied to the giver). This method of transfer is preferred for low tensile-strength yarns.

Figure 7:
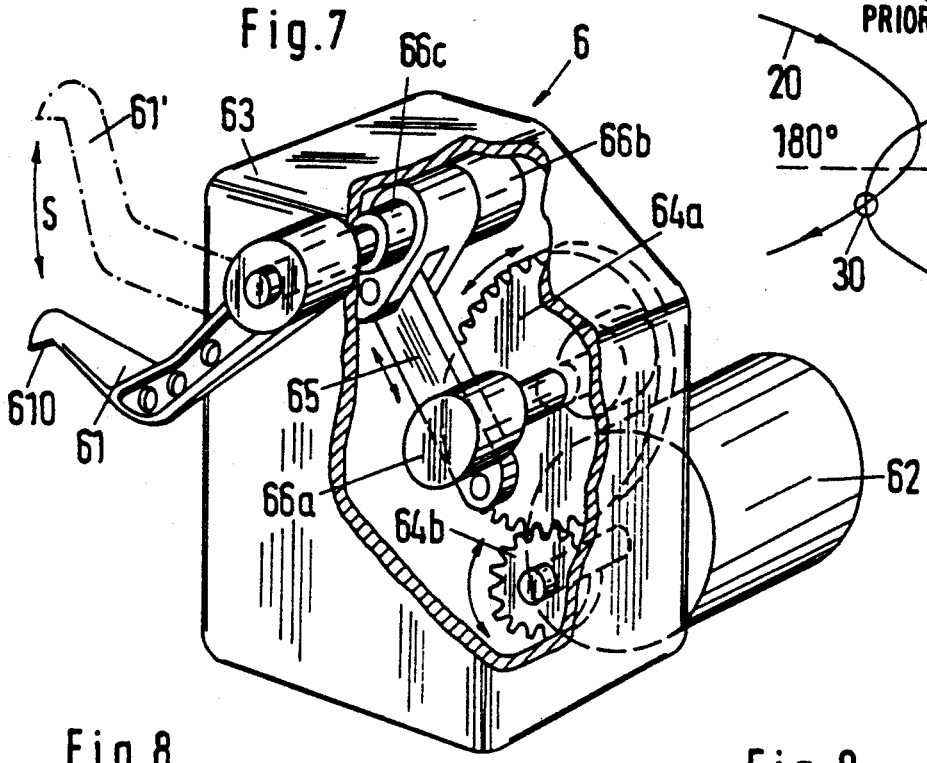
FIG. 7 is a perspective view of a clamp opener according to the invention.
Figure 8:
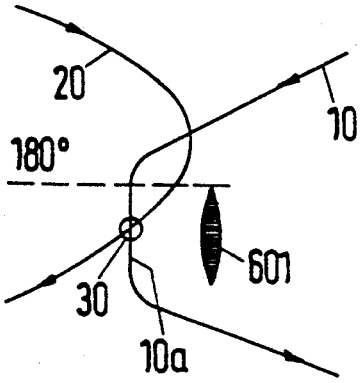
FIG. 8 is a partial view of a diagram corresponding to FIG. 5 for a first embodiment of the invention.

In a first embodiment of the invention wherein the giver tape wheel is driven by a programmed servomotor and a clamp opener 6 of the kind shown in FIG. 7 is associated with the giver at the transfer position in mid-shed, the circumstances shown in FIG. 8 can be produced. There is some similarity to the "out-of-phase" rapier movement of FIG. 6, except that at yarn transfer the giver is stationary for a period of, for example, 20 MGR and the giver yarn clamp is operated by the opener 6 during this stationary phase. The interval in which the opening and subsequent closure of the giver clamp occur is symbolised in FIG. 8 by a lens-like marking 601. The advantage of automatic yarn clamp opening has already been described.

FIG. 7 shows an example of a clamp opener 6 according to the invention. The opener 6 is disposed in the loom below the cloth path near the mid-shed at the weft yarn transfer position. The servomotor 62 acts by way of the transmission disposed in the casing 63, such transmission comprising two gears 64*a*, 64*b*, and a link 65 to move a lever 61. A number of bearings disposed in or on the wall of the casing 63 are represented schematically by cylinders 66*a*, 66*b*, 66*c*. The swan-necked lever 61, which is in its normal position in FIG. 7, must be short and rigid in order to be able to open the yarn clamp of the associated rapier with very reduced vibration in order not to damage the weft yarn. The lever 61 is aligned parallel to the warp yarns of the shed (not shown). The head part with the pressing part 610 must be narrow so as to be pivotable, as indicated by a double arrow S, into the shed between the warp yarns without damaging the same. The operative position 61' of the lever 61 is shown in chain-dotted lines in FIG. 7. By means of a small downwards pivoting movement the lever 61 when in the operative position 61' can press the lever actuating the rapier yarn clamp.

The clamp opener 6 according to the invention can be constructed to take up less space than the known clamp openers (DE-OS 3 224 708). This is very important since the physical conditions in a loom below the cloth path are usually difficult and do not allow the known devices to be used. An even more compact clamp opener can be devised if an intermediate transmission for the tape wheel drive is abandoned as already suggested for the servomotor.

Figure 9:
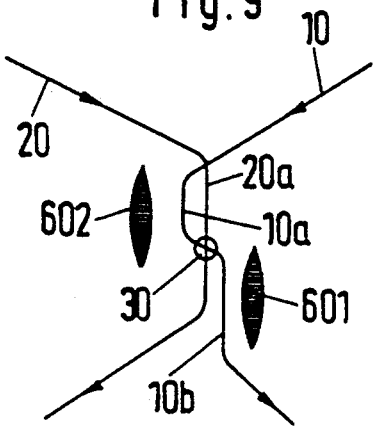
FIG. 9 is a view similar to FIG. 8 for a second embodiment.

The circumstances shown in FIG. 9 can be achieved for a second embodiment of the invention wherein the tape wheels of both rapiers are driven by programmed servomotors and clamp openers 6 according to the invention are associated with both rapiers. Before yarn transfer the two rapier heads reach their reversal positions virtually simultaneously and remain there briefly in a stationary phase (curve portions 10*a*, 20*a*). The taker clamp opens first (interval 602) and the giver makes a slight withdrawing movement, the weft yarn sliding into the opened clamp of the taker. In a second stationary phase of the giver (curve portion 10*b*) the giver clamp opens (interval 601) so that the still stationary taker, whose yarn clamp now closes, can draw the weft yarn from the giver clamp and pull it along in its return movement. After the closure of the giver clamp the giver can make its return movement.

The rapiers and more particularly their yarn clamps can be so modified that the clamp openers according to the invention can act on them while the rapiers are moving. In the event of such a modification the levers actuating the yarn clamps have, for example, rollers or slideways. In this event there is no need for the rapiers to be stationary during the automatic actuation of their clamps by the openers.

When openers according to the invention are used automatic operation of the wedge clamps is not required. If, however, as in the first embodiment, a clamp opener is associated only with the giver, the taker should still have a wedge clamp.

The tape wheel drive by servomotors can be used advantageously during phases other than yarn transfer between the two rapiers. The takeover of the weft yarn presented to it by the giver at the shed entry is a particular source of disturbances, "mis-entrainments" being likely. The frequency of such mis-entrainments can be reduced by a programmed deceleration or even by a brief stoppage of the giver at the shed entry.

Figure 10:
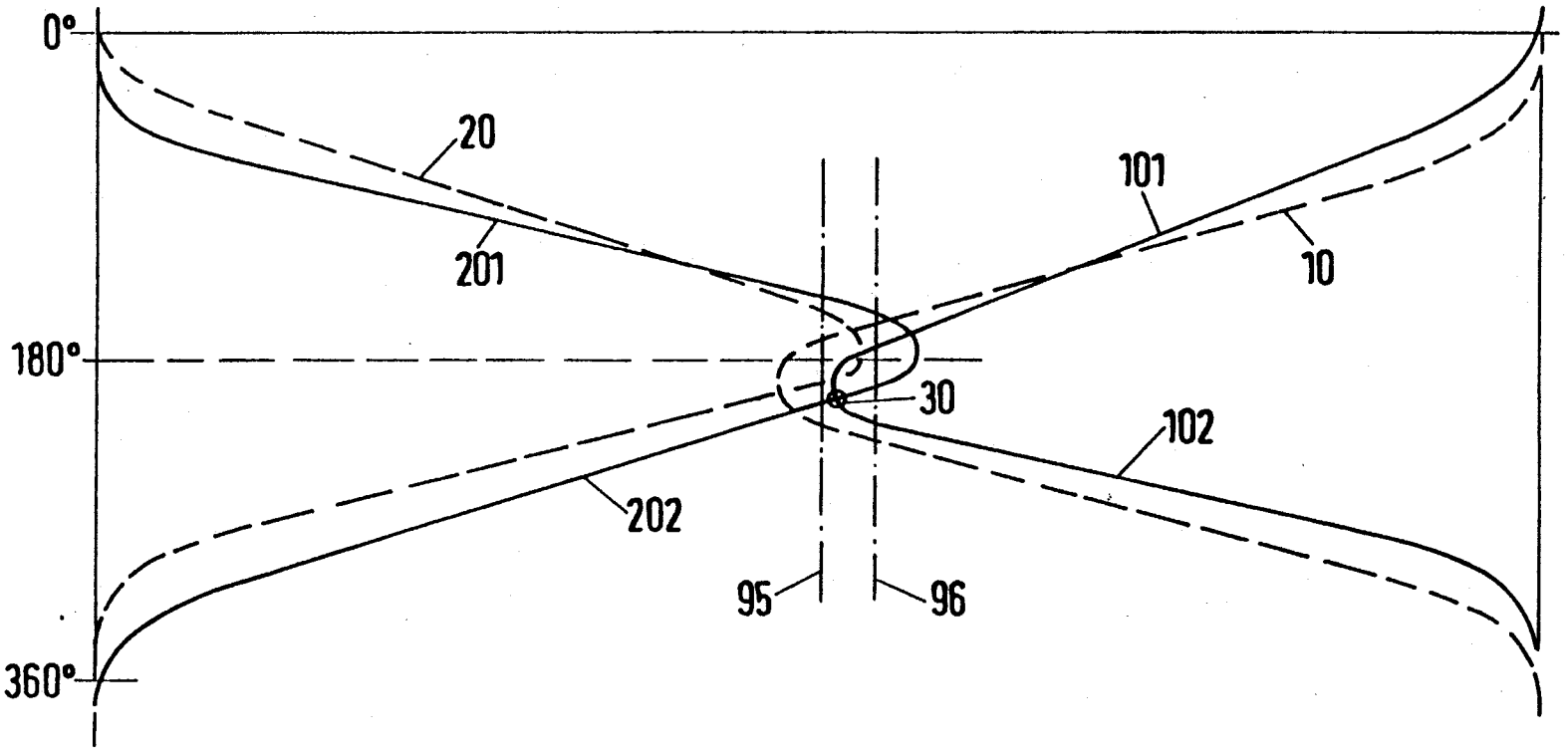
FIG. 10 is a diagram showing asymmetrical rapier movements.

As FIG. 10 shows, the tape wheel drive by servomotors can be used to produce an asymmetric rapier movement pattern. The symmetrical pattern for out-of-phase rapier movement is shown in chain-dotted lines in FIG. 10 (cf. FIG. 6). The solid-line curves represent the example of asymmetrical rapier movement. Yarn transfer is "eccentric" in the case of the line 96 which is displaced towards the giver side with reference to the centre line 95 where yarn transfer occurs in symmetrical conditions (to make the yarn transfer, more particularly the yarn takeover by the taker at the position 30, more overseeable, the central zone of the diagram is not to scale). As a comparison with the chain-dotted curves shows, the inwards movement (curve portion 101) of the giver is slower than its outwards movement (curve portion 102). The reverse is the case for the taker (curve portions 201 and 202 respectively). This is advantageous since in the slower movement the two givers each convey the weft yarn with them and since the forces applied thereto are reduced.

Rapier looms having the tape wheel drives according to the invention and the clamp openers according to the invention, high-dyanamic servomotors in particular being used, are particularly suitable when the looms are controlled on an area basis—i.e., by a central computer control.

We claim:

1. A rapier loom comprising:

a giver rapier and a taker rapier, each rapier including a yarn clamp movable between open and closed positions and means for opening said yarn clamp;

a first drive for reciprocating said giver rapier transversely to a shed toward and away from a reversal position in the region of the center of the shed;

a second drive for reciprocating said taker rapier toward and away from a reversal position in the region of the center of the shed, said first and second drives being synchronized such that said rapiers move toward and away from each other and cooperate with one another at a yarn transfer position near the reversal positions in the region of the center of the shed;

means for actuating the opening means of one of said giver and taker rapiers, said actuating means being positioned below the shed in the region of yarn transfer; and a programmed servomotor drivingly coupled to said actuating means and having means associated therewith for controlling the actuation of said actuation means to control the interval in which the respective yarn clamp is maintained in its open position, said control means being adjustable to vary said interval.

2. The rapier loom of claim 1 wherein one of said first and second drives comprise a programmed servomotor having means for controlling the velocity of the respective rapier, said control means being adjustable to control the velocity of the respective rapier.

3. The rapier loom of claim 2 wherein said first drive comprises said programmed servomotor having said rapier velocity control means, said rapier velocity control means being set to maintain said giver rapier substantially stationary at its reversal position for an interval of a few loom degrees.

4. The rapier loom of claim 3 wherein said actuating means is associated with said giver rapier and the control means associated with said actuating means is set such that the giver rapier yarn clamp is maintained open during the interval in which the giver rapier is maintained substantially stationary.

5. The rapier loom of claim 2 wherein said first drive reciprocates the giver rapier between a position outside the shed and its reversal position and said first drive comprises said programmed servomotor having said rapier velocity control means, said rapier velocity control means being set such that said giver rapier decelerates at shed entry.

6. The rapier loom of claim 2 wherein said first drive reciprocates the giver rapier between a position outside the shed and its reversal position and said first drive comprises said programmed servomotor having said rapier velocity control means, said rapier velocity control means being set such that said giver rapier undergoes a brief stop at shed entry.

7. The rapier loom of claim 2 wherein said programmed servomotor is a high-dynamic servomotor.

* * * * *